US006997231B1

(12) United States Patent
Jung et al.

(10) Patent No.: US 6,997,231 B1
(45) Date of Patent: Feb. 14, 2006

(54) METHOD FOR VACUUM DIECASTING AND DIECASTING MOULD

(75) Inventors: Paul Jung, Niederuzweil (CH); Werner Brugger, Niederuzwil (CH); Benno Niedermann, Niederglatt (CH)

(73) Assignee: Buhler Druckguss AG, Uzwill (CH)

( * ) Notice: Subject to any disclaimer, the term of this patent is extended or adjusted under 35 U.S.C. 154(b) by 0 days.

(21) Appl. No.: 09/937,873

(22) PCT Filed: Feb. 21, 2000

(86) PCT No.: PCT/CH00/00093

§ 371 (c)(1),
(2), (4) Date: Mar. 18, 2002

(87) PCT Pub. No.: WO00/59658

PCT Pub. Date: Oct. 12, 2000

(30) Foreign Application Priority Data

Apr. 1, 1999 (DE) ..... 199 14 830

(51) Int. Cl.
*B22D 27/15* (2006.01)
*B22D 18/06* (2006.01)
*B22D 17/14* (2006.01)

(52) U.S. Cl. ..... 164/61; 164/253; 164/113; 164/306; 164/312

(58) Field of Classification Search ..... 164/61, 164/63, 65, 253, 254, 113, 306, 312, 313
See application file for complete search history.

(56) References Cited

U.S. PATENT DOCUMENTS 5,246,055 A * 9/1993 Fields et al. ..... 164/61
5,423,369 A * 6/1995 Ota et al. ..... 164/63

FOREIGN PATENT DOCUMENTS

JP 02151358 A * 6/1990
JP 03151154 A * 6/1991
JP 03151155 A * 6/1991
JP 04178254 A * 6/1992

* cited by examiner

*Primary Examiner*—Kiley Stoner
*Assistant Examiner*—Kevin McHenry
(74) *Attorney, Agent, or Firm*—Merchant & Gould, P.C.

(57) ABSTRACT

The invention relates to a method for vacuum diecasting and a diecasting mould (1), especially for diecasting components made of metal or the alloys thereof. The aim of the invention is to provide a better casting quality while simplifying the procedure of the method. To this end, the evacuation of the die cavity (5) and the filling with molten bath are carried out independently from one another.

10 Claims, 1 Drawing Sheet

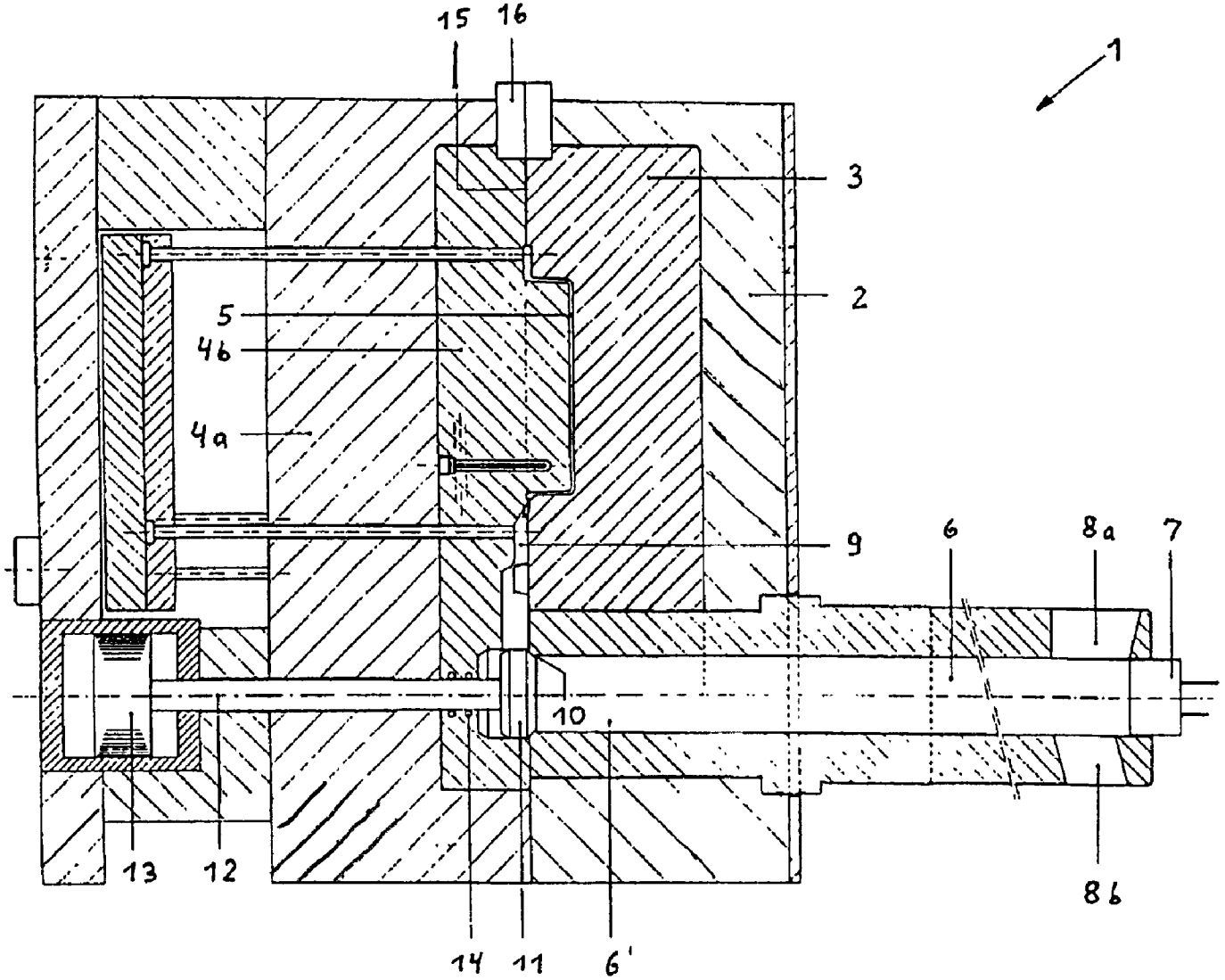
1
7
8a
8b
6
3
2
9
6'
10
11
14
16
15
5
4b
4a
12
13

METHOD FOR VACUUM DIECASTING AND DIECASTING MOULD

BACKGROUND OF THE INVENTION

The invention concerns a process for vacuum die casting, particularly for the production of the partial vacuum in the casting chamber and the mold cavity of a die casting mold, as well as a die casting mold.

RELATED ART

According to a vacuum die casting process according to the teaching of EP-B-51310, the molten metal is sucked by means of a partial vacuum into the casting chamber. The partial vacuum is induced in the casting mold by means of a suction channel. This partial vacuum is maintained until the casting mold is filled with metal melt by the feed motion of the casting plunger.

SUMMARY OF THE INVENTION

DE-A-4239558 also describes a process of this type, with the evacuation being improved and an application for the normal die casting process also being given. For this purpose, the partial vacuum is not only considered in regard to its size (pressure value and duration), but the vacuum is also to be adjusted to the exact conditions. This is to occur through a continuous regulation of the vacuum over the duration of application of the partial vacuum, particularly to prevent premature entry of metal melt into the mold cavity. The application of partial vacuum to the casting mold and/or casting chamber via at least one control valve occurs in such a way that the partial vacuum in the mold cavity and/or in the casting chamber is controlled, according to an adjustable curve with at least two time segments, as a function of the quantity introduced and/or the casting plunger path. This is costly and unreliable.

DE-A-19605727 shows a vacuum die casting machine in which the mold halves are sealed to one another by means of a sealing arrangement. In order to prevent pressing compressed air into the metal melt of the holding furnace, the casting plunger closes the suction tube during the partial vacuum phase.

DE-PS-921881 shows blocking the pouring channel without degassing by means of a movable insert bushing.

An effective plunger seal in the form of a ring device for vacuum die casting is taught by DE-A-4312647. This is to prevent the casting material reaching the mold cavity before the plunger drives the shot into the mold cavity.

According to DE-C-3834777, a detection element is provided in a degassing device of a die casting machine which recognizes metal being poured in and outputs a signal. Premature penetration of metal can, however, not be prevented.

Performing oxygen measurement in the mold cavity is also known according to JP-A-10249511.

SUMMARY OF THE INVENTION

The invention thus has as its object the development of a process for vacuum die casting which avoids the disadvantages of the prior art, particularly through a simpler and more reliable process control, and allows improved casting quality and an increase of the available shot time.

The basic idea of the invention consists of separating the evacuation procedure and the filling of the mold from one another and performing both procedures independently from one another.

A further object of the invention consists of developing a die casting mold for performing the process.

Advantageous embodiments are indicated in the following description.

The advantage of the invention consists above all in that through the temporary spatial separation of evacuation and subsequent filling of the mold, more time is available for evacuation of the mold cavity, and for the individual shot (without increasing the shot time itself), and simultaneously the quality of the parts is improved and better alloys can also be processed.

BRIEF DESCRIPTION OF THE DRAWINGS

The invention is described more detail in the following in an exemplary embodiment with reference to a drawing. The drawing shows a simplified view of a casting chamber in the single FIGURE.

DETAILED DESCRIPTION

The general design of a die casting machine and of a vacuum die casting machine is generally known, e.g. from DE-A-4239558.

A vacuum die casting mold 1 shown in a schematic and simplified illustration has a fixed mold plate 2 with a fixed mold insert 3 attached to it, which in the closed state fits with a movable mold half 4*a* with the mold insert 4*b*. The mold cavity 5 to be filled with metal melt is formed between the mold inserts 3, 4*b*.

Furthermore, the die casting mold 1 has a casting chamber 6 with a casting plunger 7 guided in it. By means of a metering opening 8*a* and/or 8*b*, feeding and metering of the metal melt occurs alternately from below and/or from above from a holding container (not shown).

The channel opening 10 of the casting chamber 6 can be closed with a beveled valve 11 in the region of the injection channel 9. The valve 11 is connected with a typical hydraulic element 13 via a plunger rod 12. A seal 14 seals the valve system off from the evacuated mold cavity 5. Other typical means could also be used instead of a hydraulic element.

The mold cavity 5 is connected via a degassing channel 15 with a typical device for partial vacuum generation, as well as a vacuum isolating valve 16.

When the mold is closed, the channel opening 10 is closed by means of the valve 11 and the hydraulic element 13. The process sequence can be described as follows:

- before the molten metal reaches the casting chamber 6, the mold cavity 5 and the injection channel 9 can already be evacuated via the isolating valve 16,
- after completed metering of the metal, the pressing procedure is started, in which the casting plunger 7 slowly moves forward (left) over the metering opening 8,
- the degassing of the casting chamber 6 occurs during the movement forward of the casting plunger 7 via the throttle channel 10 in the valve 11 or separate degassing channels or by connection of a separate vacuum loop,
- when the casting chamber is 100% filled with metal melt, the valve 11 abruptly opens by means of the hydraulic element 13 and releases the path for the metal into the injection channel 9 and into the mold cavity 5.

The pulse for the switching can also be path dependent or be performed by means of a sensory device known per se.

The metal melt fills the mold cavity 5 very quickly and without interference from compression of displaced air.

The mold cavity 5 to be filled is only released when it has been degassed. The metal melt is previously 100% prepoured into the casting chamber 6, 6'.

In addition, a further degassing of the casting chamber 6' (6) and/or of the valve 11 in the injection channel 9 can be provided. In the first phase of the evacuation, the metering opening 8 is closed by the casting plunger 7.

The hydraulic element 13 is temperature-separated from the casting chamber 6 and mold due to the arrangement described.

Reference Numbers

1 vacuum die casting mold
2 mold plate
3 mold insert
4*a* mold half
4*b* mold insert
5 mold cavity
6 casting chamber
6' part of the casting chamber
7 casting plunger
8*a* metering opening
8*b* metering opening
9 injection channel
10 throttle channel
11 valve
12 casting plunger rod
13 hydraulic element
14 seal
15 degassing channel
16 vacuum isolation valve

What is claimed is:

1. A die casting mold for the production of cast parts from metals and/or their alloys, comprising:

a mold cavity having at least first and second sides;

a casting chamber;

an injection channel;

an isolation valve positioned at the first side of the mold cavity;

a vacuum device for evacuation of the mold cavity and injection channel through the isolation valve; and a chamber valve movable to control an opening between the casting chamber and the injection channel and being positioned at the second side of the mold cavity.

2. A die casting mold according to claim 1, further comprising a casting plunger associated with one end of the casting chamber, and the opening between the casting chamber and the injection channel lies opposite to the casting plunger.

3. A die casting mold according to claim 1, wherein the chamber valve is provided with a seal.

4. A die casting mold according to claim 3, wherein the chamber valve is connected via a plunger rod with a hydraulic element in such a way that temperatures of the chamber valve and hydraulic element are different.

5. A die casting mold according to claim 1, wherein the chamber valve is connected via a plunger rod with a hydraulic element in such a way that temperatures of the chamber valve and hydraulic element are different.

6. A process for vacuum die casting metals and/or metal alloy parts with a die casting mold, the die casting mold including a mold cavity having first and second sides, a casting chamber, an injection channel, a vacuum device, an isolation valve, and a chamber valve distinct from the isolation valve that is positioned between the casting chamber and the injection channel, comprising:

evacuating the mold cavity and injection channel through the isolation valve with the vacuum device at the first side of the mold cavity;

filling the casting chamber completely with metal melt; and filling the mold cavity with molten melt from the casting chamber through the chamber valve at the second side of the mold cavity after the evacuating step.

7. A process according to claim 6, wherein the mold cavity is evacuated while the casting chamber is being filled.

8. A process according to claim 7, wherein the chamber valve is hydraulically controlled.

9. A process according to claim 6, wherein the chamber valve is hydraulically controlled.

10. A die casting mold for the production of cast parts from metals and/or their alloys, comprising:

a mold cavity;

a casting chamber;

an injection channel;

an isolation valve;

a vacuum device for evacuation of the mold cavity and injection channel through the isolation valve; and a chamber valve movable within the casting chamber to control an opening between the casting chamber and the injection channel, the chamber valve being operable independent of the isolation valve.

* * * * *